US008317048B2

(12) United States Patent
Hajichristou et al.

(10) Patent No.: US 8,317,048 B2
(45) Date of Patent: Nov. 27, 2012

(54) SELF-ACTUATING CLOSURE MECHANISMS FOR CLOSABLE ARTICLES

(76) Inventors: Louis Hajichristou, Agioi Trimithias (CY); Christina Hajichristou, Agioi Trimithias (CY)

( * ) Notice: Subject to any disclaimer, the term of this patent is extended or adjusted under 35 U.S.C. 154(b) by 601 days.

(21) Appl. No.: 12/497,559

(22) Filed: Jul. 3, 2009

(65) Prior Publication Data

US 2010/0032403 A1 Feb. 11, 2010

Related U.S. Application Data

(60) Provisional application No. 61/087,814, filed on Aug. 11, 2008, provisional application No. 61/107,546, filed on Oct. 22, 2008, provisional application No. 61/141,395, filed on Dec. 30, 2008.

(51) Int. Cl.
*B65D 41/36* (2006.01)
*B65D 51/00* (2006.01)

(52) U.S. Cl. ..... 220/230; 220/298

(58) Field of Classification Search ..... 215/337, 215/329; 220/230, 298
See application file for complete search history.

(56) References Cited

U.S. PATENT DOCUMENTS

| | | | | |
|---|---|---|---|---|
| 2,717,096 | A | 9/1955 | Henderson | |
| 3,478,911 | A | 11/1969 | Hedgewick et al. | |
| 3,931,891 | A * | 1/1976 | Peppler | 206/538 |
| 3,961,721 | A | 6/1976 | Gordon et al. | |
| 4,223,799 | A * | 9/1980 | Eyster et al. | 220/230 |
| 4,489,842 | A | 12/1984 | Bobrove | |
| 5,038,829 | A * | 8/1991 | Panella | 138/89 |
| 5,199,597 | A | 4/1993 | Gladish | |
| 5,534,663 | A | 7/1996 | Rivers et al. | |
| 5,957,313 | A * | 9/1999 | Bouan | 215/215 |
| 6,336,567 | B1 | 1/2002 | Hyobu | |
| 6,382,450 | B1 * | 5/2002 | De Rosa et al. | 220/230 |
| 6,491,177 | B1 | 12/2002 | Hyobu | |
| 6,659,516 | B2 | 12/2003 | Wang et al. | |
| 7,156,252 | B2 | 1/2007 | Morin | |
| 7,172,101 | B2 | 2/2007 | Find | |
| 7,607,430 | B2 * | 10/2009 | Davis | 128/200.11 |
| 7,770,601 | B2 * | 8/2010 | Perry | 138/89.3 |
| 2002/0130128 | A1 * | 9/2002 | Berglund | 220/230 |
| 2004/0178200 | A1 * | 9/2004 | Langlois et al. | 220/230 |
| 2008/0264944 | A1 * | 10/2008 | Hui | 220/230 |

FOREIGN PATENT DOCUMENTS

| | | | |
|---|---|---|---|
| CH | 658438 | A | 11/1986 |
| DE | 2064615 | | 12/1971 |
| DE | 3921540 | A1 | 3/1991 |
| EP | 0630823 | | 12/1994 |
| FR | 2623166 | | 5/1989 |
| GB | 2264975 | A | 9/1993 |
| JP | 1167055 | | 6/1989 |

OTHER PUBLICATIONS

"Medium Size Clear Plastic Container with a Strong Magnetic Lid thst [sic] will Stick to Most Metals;" <www.thisnext.com/item/3A967EI 5/3C73259E/Medium-size-Clear-Plastic>.

* cited by examiner

*Primary Examiner* — Mickey Yu
*Assistant Examiner* — Niki Eloshway
(74) *Attorney, Agent, or Firm* — Ronald Abramson; Hughes Hubbard & Reed LLP

(57) ABSTRACT

A self-activating closure mechanism is described. In certain embodiments, containers or closures have closure elements, which, upon being brought into proximity to each other, are drawn together and urged into alignment to engage locking members by magnets or other mutually attractive or repulsive elements, thereby providing a self-closing assembly.

20 Claims, 8 Drawing Sheets

SELF-ACTUATING CLOSURE MECHANISMS FOR CLOSABLE ARTICLES

CROSS-REFERENCE TO RELATED APPLICATIONS

This application claims the benefit pursuant to 35 U.S.C. §119(e) of the respective filing dates of the following U.S. provisional patent applications: (1) U.S. provisional patent application No. 61/087,814, filed Aug. 11, 2008, (2) U.S. Provisional Patent Application No. 61/107,546, filed Oct. 22, 2008, and (3) U.S. Provisional Patent Application No. 61/141,395, filed Dec. 30, 2008. The entire disclosure of each of said U.S. provisional patent applications is incorporated herein by reference.

BACKGROUND OF THE INVENTION

1. Field of the Invention

The invention is in the field of the mechanical arts, and more particularly concerns self-actuating closure mechanisms for articles having components that are mutually closable, more particularly including self-actuating closure mechanisms that may be rotationally engaged, including without limitation embodiments in the form of lidded containers with self-closing mechanisms that operate to automatically mechanically lock and seal the container, no matter how the lid is placed on the container.

2. Description of the Related Art

An example of an article having closable components that may be rotationally engaged is a jar with a threaded lid. Common kitchen jars are often dropped and broken because the lid has not been properly threaded by the previous user.

Currently, most containers use a standard threaded locking/sealing mechanism or a latch, both of which require specific force to achieve a lock and seal. In the event this required force is not applied properly or fully, two main issues may arise: (1) the seal is not achieved, thereby potentially compromising the contents of the container, or (2) the lock is not adequate, thereby potentially risking the container and contents should the container be picked up by the lid.

A prior solution to this problem is to provide containers with a lid having a press-shut clip closure. However, press fit clip lids are only viable for light weight containers and contents. They must be actively pressed shut. Also, most clip lids do not provide an adequate seal.

Accordingly, a need exists for a self-closing container providing an effective and robust seal for a wide range of contents. More generally, a need exists for more modern closure mechanisms that are self-actuating and convenient, yet provide a strong and positive closure.

SUMMARY OF THE INVENTION

It is an object of the invention to provide a self-activating closure that operates in a convenient and straightforward manner and, when incorporated into a container, provides an effective and robust seal for a wide range of container contents. Other desired attributes include:

- The mechanism should preferably close automatically in a smooth and predictable manner, avoiding indefinite, "blocked" or "hung" states in which closure stops short of full engagement.
- The closure should preferably engage in a manner that provides strong, positive resistance to disengagement, when subjected to forces and movements other than a specific, intended disengaging operation.

- The disengaging operation should preferably involve different forces and movements than those resulting from routine storage and handling.
- The closure mechanism should preferably be capable of incorporating a positive seal for solid, liquid and/or gaseous contents.

In certain embodiments, the present invention achieves these objectives in part by using mutually attractive or repulsive elements such as magnets on the lid and/or the body (canister) of a container to draw the body and lid into engagement, and a mechanical interlock that activates upon engagement and secures the engaged components in a locked position. In these embodiments, the lid simply needs to be placed in proximity of the top of the canister and released. The closure mechanism shown can be adapted to any device having a closure that operates by rotation. By the same principles illustrated, the mechanism can be adapted to nonrotating embodiments, such as closures that linearly slide into place, embodiments with latches, and other closures.

Other aspects and advantages of the invention will be apparent from the accompanying drawings, and the detailed description that follows.

BRIEF DESCRIPTION OF THE DRAWINGS

For a more complete understanding of the present invention and the advantages thereof, reference is now made to the following description taken in conjunction with the accompanying drawings, wherein like reference numerals represent like parts, in which:

FIG. 1A is a top perspective partially transparent view of the container illustrated throughout the various other views of FIGS. 1A-1J.

FIG. 1B is a partially transparent side elevational view of the container of FIG. 1A.

FIG. 1C is a partially transparent top plan view of the container of FIG. 1A.

FIG. 1D is a larger partially transparent side elevational view of the container of FIG. 1A.

FIG. 1E is a detailed view of area 1E of FIG. 1D.

FIG. 1F is a partially transparent side elevational view of the container of FIG. 1A, pointing out the section 1H taken for FIG. 1H.

FIG. 1G is a partially transparent top plan view of the container of FIG. 1A, pointing out the section 1J taken for FIG. 1J.

FIG. 1H is a partially transparent cross-sectional side view of the container of FIG. 1A.

FIG. 1I is a detailed view of area 1I of FIG. 1H.

FIG. 1J is a partially transparent cross-sectional side view of the container of FIG. 1A.

DETAILED DESCRIPTION OF PREFERRED EMBODIMENTS

The following is a description of alternative preferred embodiments of the invention. These embodiments are illustrative only, and the invention, as defined by the claims, is by no means limited to particular examples shown. For example, certain preferred embodiments are described in relation to an implementation with specific magnetic attraction elements, pins, and channels, but it should be appreciated that the disclosure that follows was intended to enable those skilled in the art readily to apply the teachings set forth to other commonly available hardware and materials. The specific features of any particular embodiment should not be understood as limiting the scope of what is claimed.

The specific embodiments presented herein for purposes of illustrating the invention may be implemented in a rotationally engaging mechanical context concern containers, such as might be used in the kitchen. Of course embodiments other than containers also exist in which the mutually closing members can be engaged with a rotating motion.

An illustrative article having a rotationally engaged closure in accordance with one embodiment of the invention, in this case article 1 as shown in FIGS. 1A-1J, comprises a body 2 and a lid 3.

We will sometimes refer herein to the "top" of body 2, and such references will be to the end of body 2 that faces lid 3 in a mutually closed position. Similarly, references to the "bottom" of lid 3 refer to the portion of lid 3 that faces body 2 in a mutually closed position. The term "axis" as used herein will refer to the rotational axis defined when rotating lid 3 to engage/disengage with body 2. "Axial" will mean aligned with the axis, and "radial" and/or "circumferential" will refer to positions in planes perpendicular to the axis.

In the embodiment illustrated in FIGS. 1A-1J, article 1 is configured as a container with a hollow interior, and is therefore sometimes also referred to as "container 1". Lid 3 is shaped to be engageable with body 2, and rotatable when engaging therewith. Outer lid lip 61 descends circumferentially downward from the top of lid 3 to form a cylindrical structure shaped and sized to drop down upon and receive the upper portion of body 2.

Figure 1A:
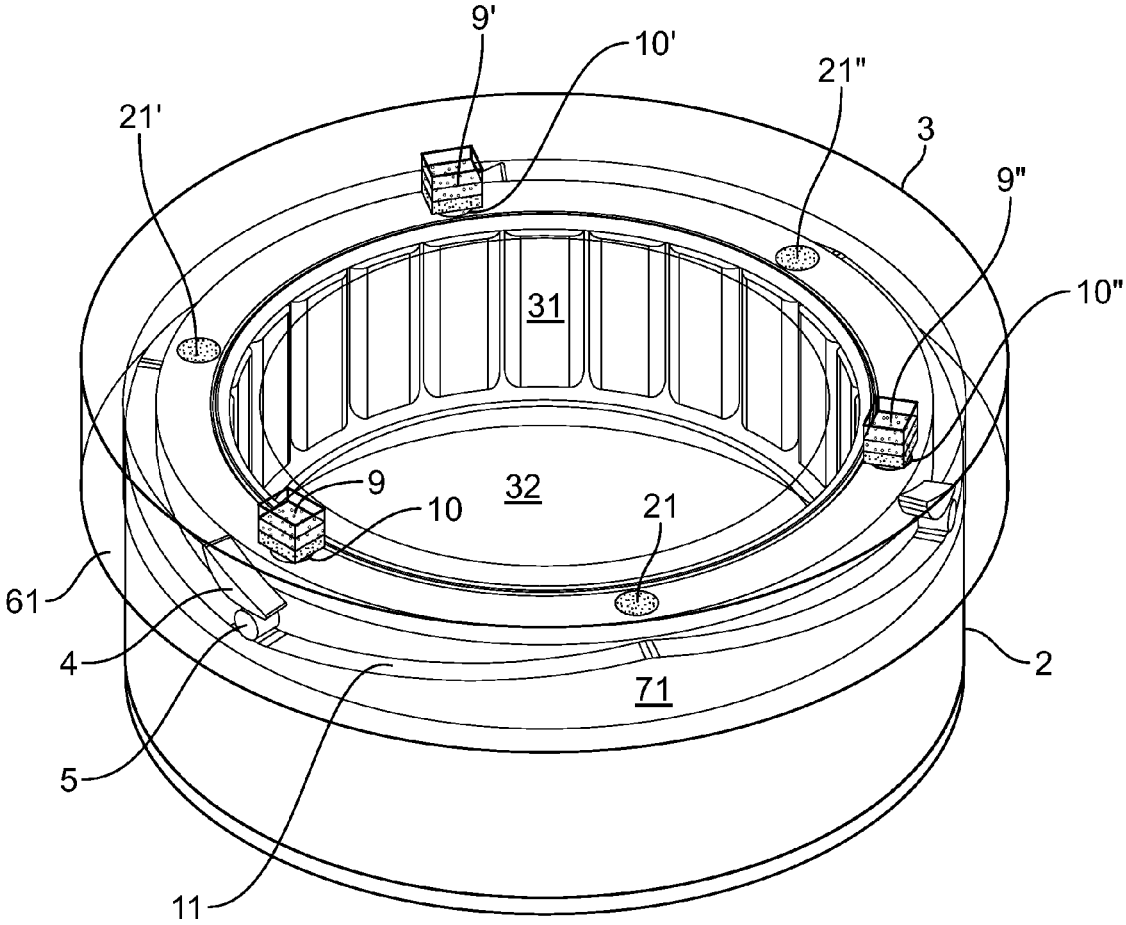
FIGS. 1A-1J show various views of an illustrative container in accordance with one embodiment of the invention.
Figure 1B:
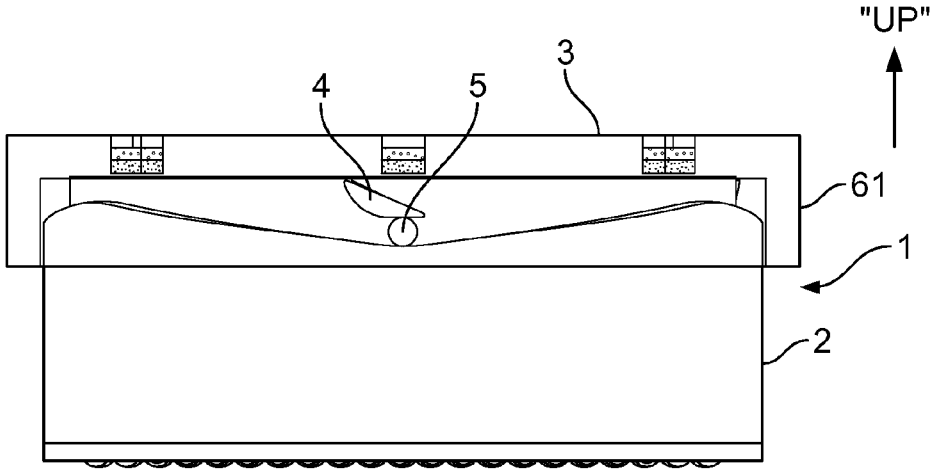
Figure 1C:
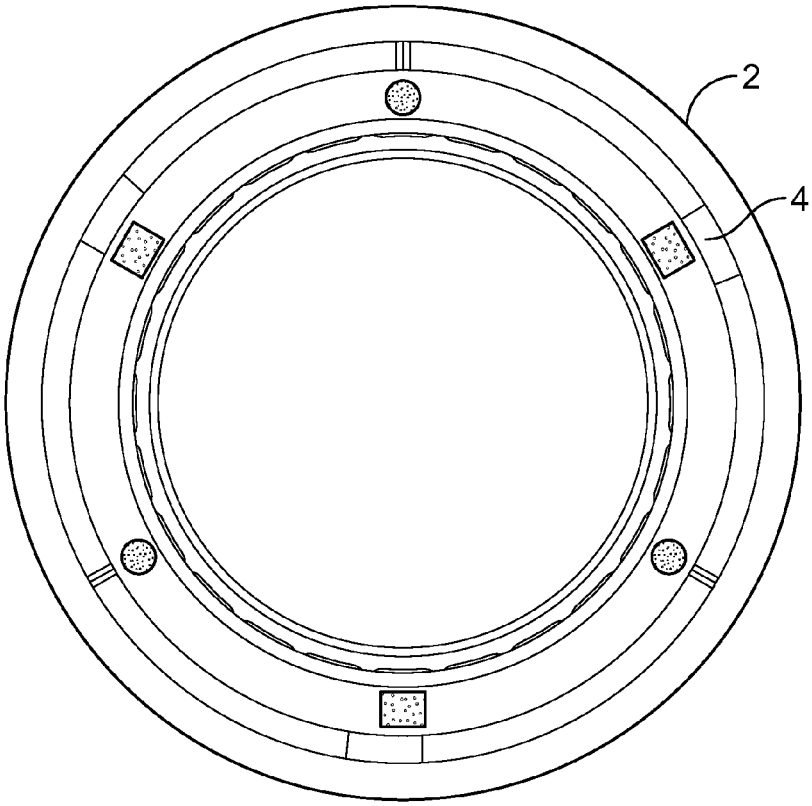
Figure 1D:
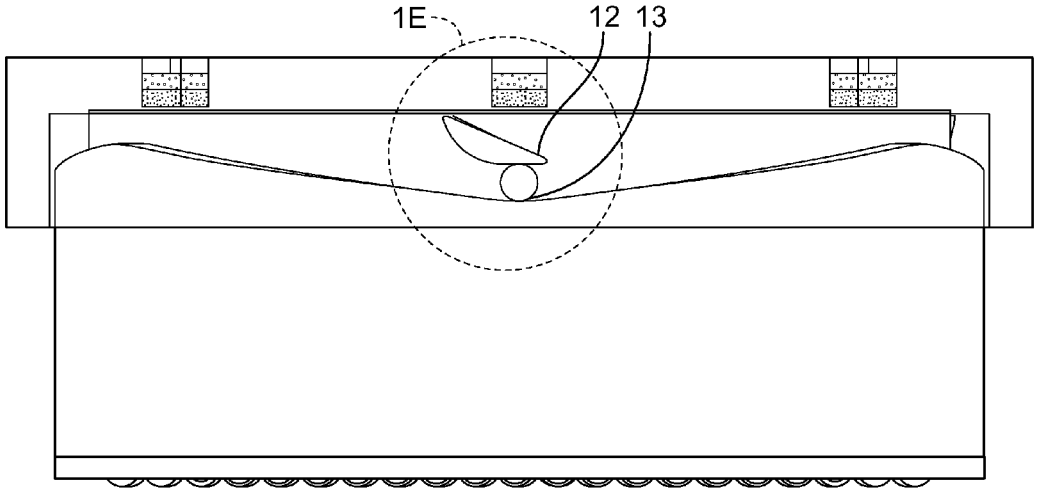
Figure 1E:
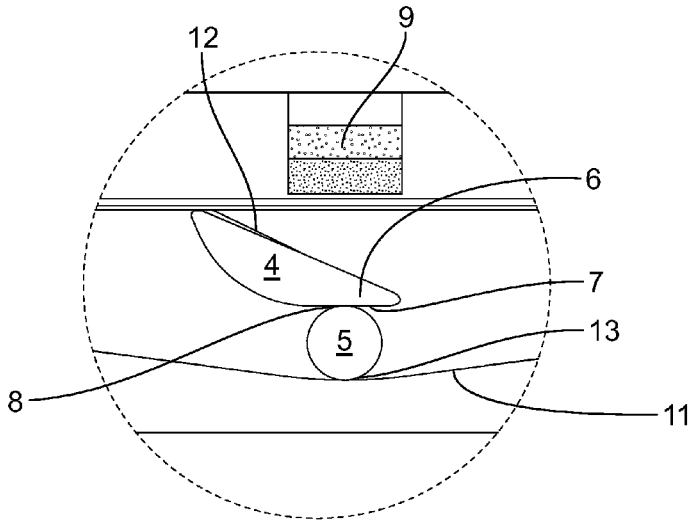
Figure 1H:
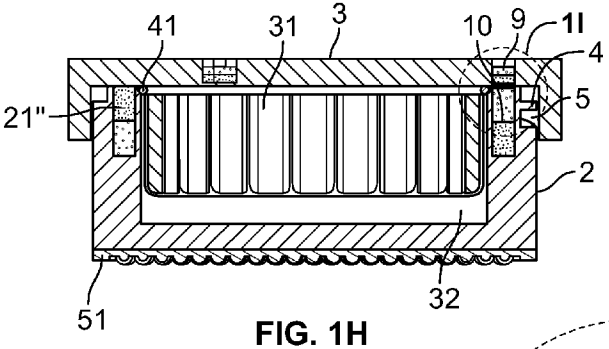
Figure 1I:
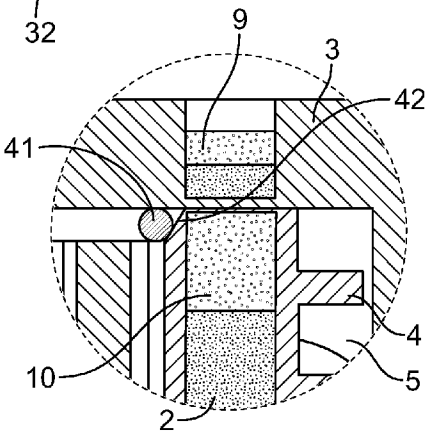
Figure 1J:
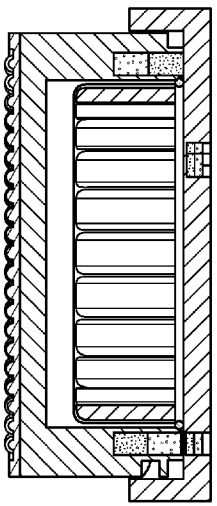
Figure 1F:
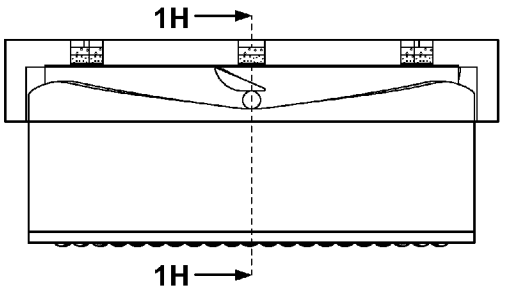
Figure 1G:
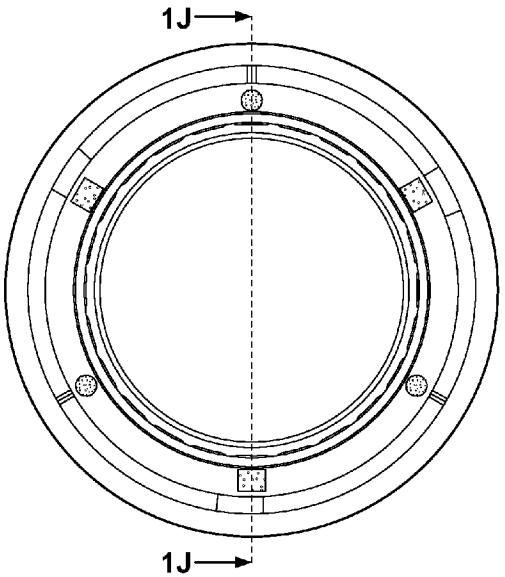
Figure 2:
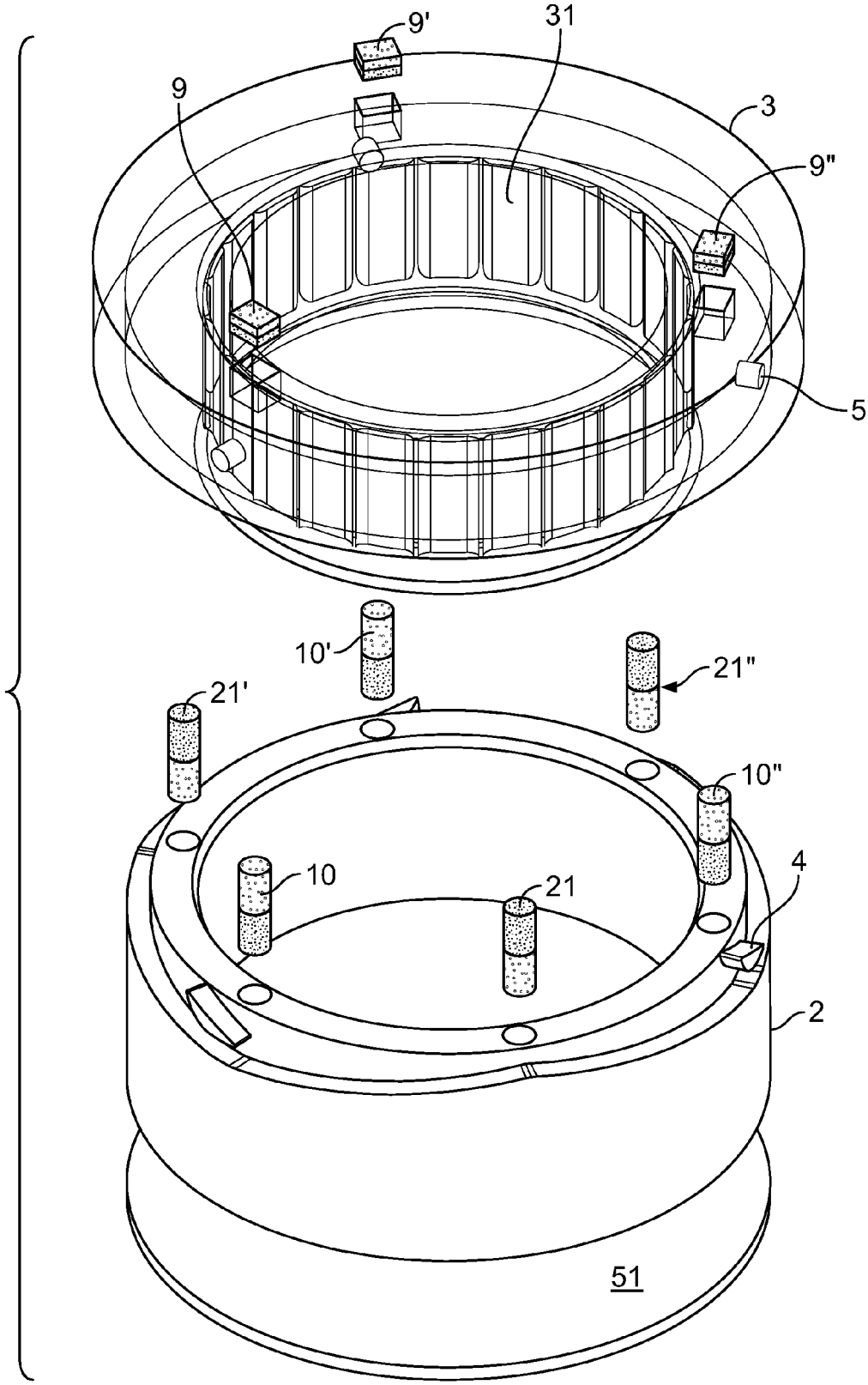
FIG. 2 is an exploded parts view of the container of FIG. 1A, in a partially transparent top perspective view.
Figure 3A:
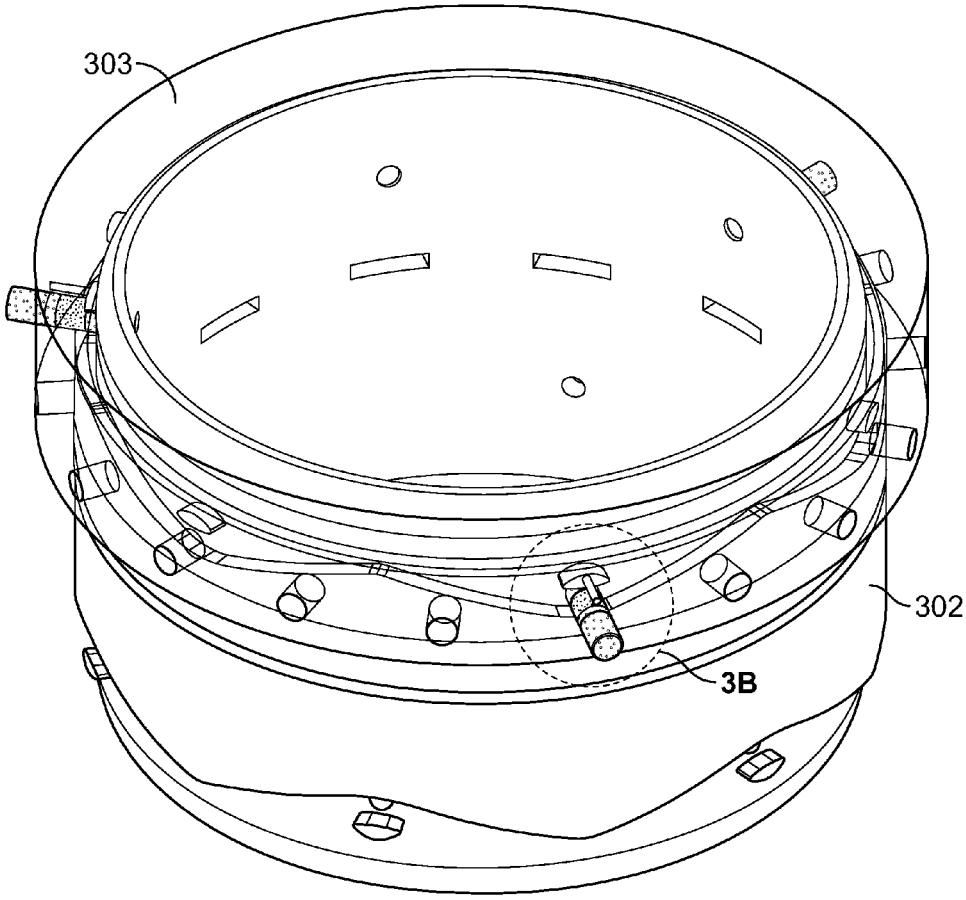
FIGS. 3A-3D show another illustrative container in accordance with an alternate embodiment employing different shaped interlock pieces than those employed in FIGS. 1A-1J.
Figure 3B:
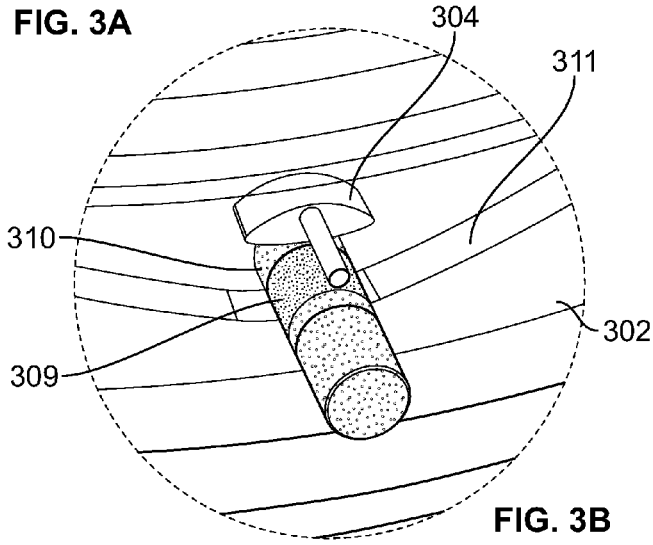
Figure 3C:
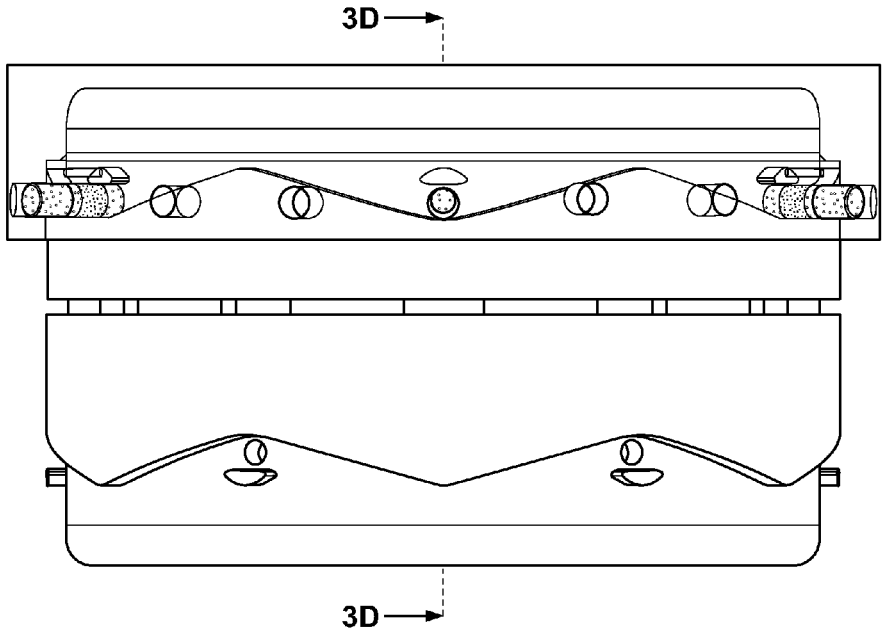
Figure 3D:
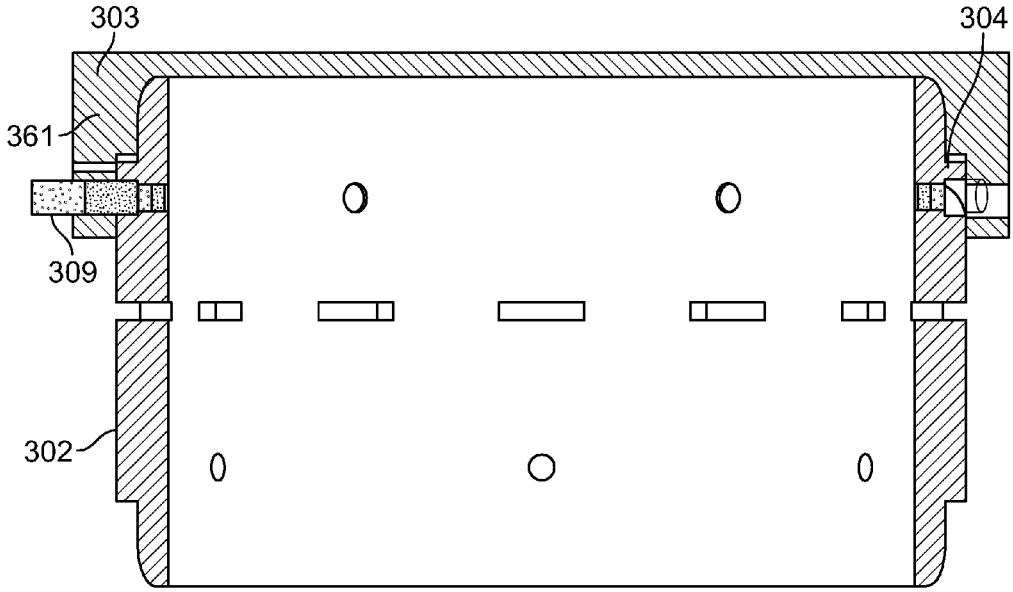

FIG. 2 also depicts container 1, in an exploded parts view.

There are at least one, and in the case of this embodiment, three, first interlock pieces shaped like first interlock piece 4, fixedly disposed on body 2. In the embodiment shown in FIGS. 1A-1J, first interlock piece 4 is generally in the shape of an inverted circle segment (with some flattening on the arced underside, near area 7, where it is near horizontal), protruding radially from the upper outer circumference of body 2 (or otherwise having a radial extent relative to body 2) and oriented so that its generally flat upper surface 12 is tilted downward, in this embodiment from left to right when viewed from the side and from outside of container 1. The three first interlock pieces in this embodiment comprise first interlock piece 4 and two other corresponding like pieces (visible but not separately referenced, in FIG. 1C), that are likewise fixedly disposed circumferentially around the upper outer circumference of body 2, at approximate 120 degree intervals.

There is at least one, and in the case of this embodiment, three, second interlock pieces shaped like second interlock piece 5, fixedly disposed on lid 3. In the embodiment shown in FIGS. 1A-1J, second interlock piece 5 has a cylindrical pin shape, oriented radially with respect to the axis of lid 3, and protruding inward from the inner circumference of lid outer lip 61 (or otherwise having a radial extent relative to lid 3). The three second interlock pieces in this embodiment comprise second interlock piece 5, and two other corresponding like pieces (visible but not separately referenced, in FIG. 2), likewise fixedly disposed circumferentially on the inner circumference of lid outer lip 61, at approximate 120 degree intervals.

The cylindrical pin shape of second interlock piece 5 (and its circumferentially corresponding elements) can rotatably engage the underside of first interlock piece 4 (and its circumferentially corresponding elements) when lid 3 is closed on body 2 and rotated relative to body 2. As may be seen in FIG. 1E, this rotational engagement has a rotationally defined area of interlock engagement 6, adjacent to the above-mentioned generally flat, horizontal portion (in the area of 7) of the underside of first interlock piece 4, wherein, within the area of interlock engagement 6, an interlocking portion 8 of second interlock piece 5 is disposed against an interlocking portion 7 (of first interlock piece 4 (i.e., a portion within said generally flat, horizontal underside area of first interlock piece 4).

Further, there is at least one pair of mutually attractive (or repulsive) elements (9, 10), the opposite elements of said pair being disposed respectively on body 2 and lid 3, and positioned thereon such that their position of strongest attraction to (or repulsion from) each other, as lid 3 rotates relative to body 2, approximately corresponds to the rotational position of lid 3 and body 2 when rotationally positioned in area of interlock engagement 6. In this embodiment, the mutually attractive/repulsive elements are magnets, and preferably strong rare earth magnets. The N/S polarity of the magnets is indicated by light/dark shading (which polarity is immaterial, so long as polarities are consistently treated). In the illustrative embodiment, there are three magnets 9, 9', and 9" circumferentially disposed at approximate 120 degree intervals around lid 3. Opposing magnets 10, 10', and 10" are circumferentially disposed at like intervals and radius on base 2. (Base 2 may also have additional magnets around its upper periphery, for example, magnets 21, 21' and 21", which are N/S-oriented in a direction opposite to the N/S orientation of the other base magnets 10, 10', and 10", so as to repel instead of attract magnets 9, 9', and 9"; such optional, oppositely oriented magnets will be discussed later in this disclosure.) The arrangement of magnets shown here (and like arrangements involving a greater or lesser number of magnets) may of course be reversed between the lid and the base. In the embodiment shown, paired magnets have been used. However, combinations of magnets and unmagnetized magnetic material may alternately be used in an equivalent manner as will be apparent to those of ordinary skill in the art.

As can be seen in various views in FIGS. 1A-1J, when magnets 9 and 10 are aligned, first and second interlocks 4 and 5 are also in an interlocked position. In the illustrated embodiment, this occurs when all of 4, 5, 9, and 10 are approximately aligned, but it is not necessary that interlock pair 4 and 5 be vertically aligned with magnet pair 9 and 10.

In addition, there is preferably at least one ramp 11 forming the bottom of an inset running at least partially around the upper outer circumference of body 2. The inner circumferential wall of the inset area above ramp 11 contains first interlock piece 4 as a radial protrusion into said inset. Ramp 11 is inclined relative to the top of body 2 to slope in the direction of area of interlock engagement 6, and runs beneath first interlock piece 4 in said area of interlock engagement 6, with sufficient clearance to accommodate second interlock piece 5. In this embodiment there are three circumferential ramps, comprising ramp 11 and two other corresponding like ramps (which may be seen in the various views of FIG. 1), again at approximate 120 degree intervals. Further in this embodiment (but not necessary to the invention), ramp 11 (and each of the other two corresponding ramps) comprises two sections, one on either side of first interlock piece 4, each section sloped symmetrically about first interlock piece 4, and running toward the underside and beneath first interlock piece 4. These three ramps together define a generally scalloped inset of varying elevational depth around the upper periphery of body 2. As may be implied from the above description, in this embodiment first interlock members 4, etc. protrude from the sides of body 2 into this scalloped inset, and the three areas of maximum ramp depth lie approximately beneath each of first interlock members 4 etc., providing clearance for second interlock piece 5 and its corresponding other two lid interlock pieces.

Ramp 11 is positioned on body 2 to receive second interlock piece 5 from above as lid 3 is drawn into compression with body 2 from a rotational position in which second interlock piece 5 is approaching a portion of ramp 11 from above ramp 11. Note that the invention will function without ramp 11. However, ramp 11 is preferred, in that it helps to engage the assistance of both gravity and magnetism in translating downward lid motion into rotation in the direction of locking, rather than relying exclusively on the magnets or other attractive/repulsive elements to induce such rotation.

The respective shapes of interlock pieces 4 and 5—in this embodiment, the shape of interlock piece 4 as an inverted generally circle-segment-shaped piece with an underside flatted area, and of second interlock piece 5 as a cylindrical pin—assist in a smooth closure of lid 3 onto body 2. The respective shapes of upper surface 12 of first interlock piece 4 and lower surface 13 of second interlock piece 5 are such that, in those cases when surfaces 12 and 13 contact each other during closure of lid 3 against body 2, surfaces 12 and 13 slide against each other when further urged together and rotated with lid 2 and body 3 (respectively). Said sliding is in a direction corresponding to closer engagement of lid 2 and body 3. Said shaping of surfaces 12 and 13 is further such that first interlock piece 4 and second interlock piece 5 slide off of each other at a further position of relative rotation and compression of lid 3 and body 2, above ramp 11 (and then second interlock piece 5 falls onto ramp 11 and proceeds into engagement as otherwise described herein with respect to ramp 11).

Preferably magnets 9, 9', and 9" will come very close to magnets 10, 10', and 10" at a closure position, but the opposing magnet surfaces preferably should not actually make physical contact. This small separation helps lid 3 maintain positive pressure against base 2 when container 1 is closed, and assists in sealing.

Base 2 may also have a central opening 32 therein defining an interior space or volume of body 2 (as would normally be the case where article 1 was, for example, a kitchen container having an interior for its contents). Preferably, lid 3 also has cylindrical inner lip 31, preferably fluted to reduce friction, disposed on the bottom of lid 3 and shaped to fit closely within the peripheral wall of central opening 32 of base 2.

When lid 3 is brought into proximity of body 2, cylindrical inner lip 31 engages the central opening 32 of body 2. Assuming lid 3 and body 2 are approximately upright, when lid 3 is let go of, it will tend to fall (primarily at first in most cases by gravity) toward body 2, preferably guided into a concentric position by cylindrical inner lip 31. As lid 3 gets close to body 2, magnets 9 and 10 (and their corresponding radial counterparts), and/or magnets 9 and 21 (and their corresponding radial counterparts) will get close enough to interact significantly. Magnets 9 and 10 mutually attract, whereas magnets 9 and 21 mutually repel. In either case, the attraction and/or repulsion serves to urge magnets 9 and 10 closer together, and interlock pieces 4 and 5 toward their locked position, and at the same time, draw lid 3 closer to body 2.

If second interlock piece 5 contacts ramp 11, these forces will tend to pull second interlock piece 5 into locked position under first interlock piece 4. If, on the other hand, in this process second interlock piece 5 comes against the upper surface 12 of first interlock piece 4, second interlock piece 5 will slide down the incline of top surface 12 of first interlock piece 4 and fall onto ramp 11, and again be drawn into locked position under first interlock piece 4. When in locked position, the interlock portion 8 on lower surface 7 of first interlock piece 4, being approximately flat, ensures that the lid remains locked, even if a container with the lid attached on is picked up from the lid.

The container in this embodiment strongly and positively resists having the lid removed other than by a specific twisting and pulling disengagement motion that rotates second interlock piece 5 out from under and clear of first interlock piece 4 (i.e., against strong magnetic force tending to keep the interlock pieces aligned), and then pulls lid 3 away from body 2 (again, against magnetic force tending to pull the lid and body together). A plain pulling force will not remove lid 2. Nor will a rocking force, lateral force, or a plain twisting force.

Preferably, repulsive magnets 21, 21' and 22' are disposed at 120 degree intervals circumferentially around body 2, at equal distances centered between magnets 10, 10' and 10". In an embodiment having one or more of these additional magnets, the body magnets are arranged in alternating polarity, to form a N-S-N-S-N-S pattern (in the case of three sets of magnets) around the upper circumference of the body. Preferably, the radial counterparts of ramp 11 intersect, i.e., have their highest points, 71, etc. in positions approximately aligned with magnets 21, 21', and 21", i.e., at positions where magnets 9, 9', and 9" will encounter approximately maximal repulsive force. This arrangement works especially well to provide a positive, automatic locking action without indefinite states, blockages, "hangs", or dead spots.

Furthermore, a seal may be provided between lid 3 and base 2. In the illustrated embodiment, such a seal is in the form of O-ring 41, seated at the base of cylindrical inner lip 31 where it joins lid 3, and against chamfer 42 on base 2 when lid 3 is in closed position on base 2. Flat sealing rings or discs could be used instead of an O-ring. O-ring 41 is dimensioned and placed so that it is approximately optimally compressed for sealing when the assembly of container 1 is in a full locked position.

Base 2 may further comprise resilient pad 51 on the bottom of base 2. This pad facilitates single-handed use of container 1. The pad provides sufficient friction against a surface such as a table or counter to overcome the attractive force of the magnets when a user twists the lid, so that the user need not necessarily hold the base with the other hand.

It is not necessary to use three lid magnets. One or more lid magnets, up to any arbitrary number, may be provided. In embodiments of this type, however, where repelling magnets are also used, there should preferably be twice the number of body magnets as there are lid magnets (or vice-versa), so they may be alternating in polarity and equally spaced, with corresponding interlock, and optionally ramp elements for each mutually attracting pair. The illustrated embodiment with three lid magnets and six body magnets is currently preferred.

Ramp 11 and first and second interlock pieces 4 and 5 and the related structures could be interchanged and/or rearranged as between lid 3 and base 2 of container 1 for equivalent operation. Similarly, lid 3 could be adapted to fit within the central opening 32 of base 2, rather than to fit over the outside top of body 2. Other variations of a similar nature will be apparent to those of ordinary skill in the art.

There are numerous other embodiments that might be developed for generally rotational closure embodiments in accordance with the principles of the invention.

For example, in an alternate embodiment, as shown in FIG. 3, there are three lid rod magnets 309 radially oriented and positioned in the inner lip 361 of lid 303; body 302 has six sets of ramps 311 with interlock pieces 304 centered over the lowest points of ramps 311 and body magnet 310 radially oriented in the wall of body 302 under interlock piece 304. Thus, in this embodiment, magnets 309 and 310 engage (or repel, as may be the case in a variation of this embodiment) from the side, rather than from the top. Rod magnets 309 do both the jobs of locking pins (5) and lid magnet (9) of the previously discussed embodiment, i.e. the 309 magnets engage with the body ramps 311 and once under the interlock piece 304 provide strong attraction to magnet 310, and thus provide a mechanical lock.

While the design of the embodiment shown in FIG. 3 is generally satisfactory, the incline of the upper surface of first interlock piece 4 of the embodiment shown in FIGS. 1A-1J has an advantage over the corresponding interlock structure shown in FIG. 3 because it avoids a potential "dead spot" in self-closure that exists in the embodiment in the FIG. 3 embodiment when the lid 303 is initially placed so that rod magnet 309 is very close to exactly centered over the top of first interlock piece 304, which is approximately level at the topmost portion of its upper surface. The unbroken and continuous incline of the top surface 12 of first interlock piece 4 in the embodiment of FIGS. 1A-1J avoids this particular situation.

Figure 4:
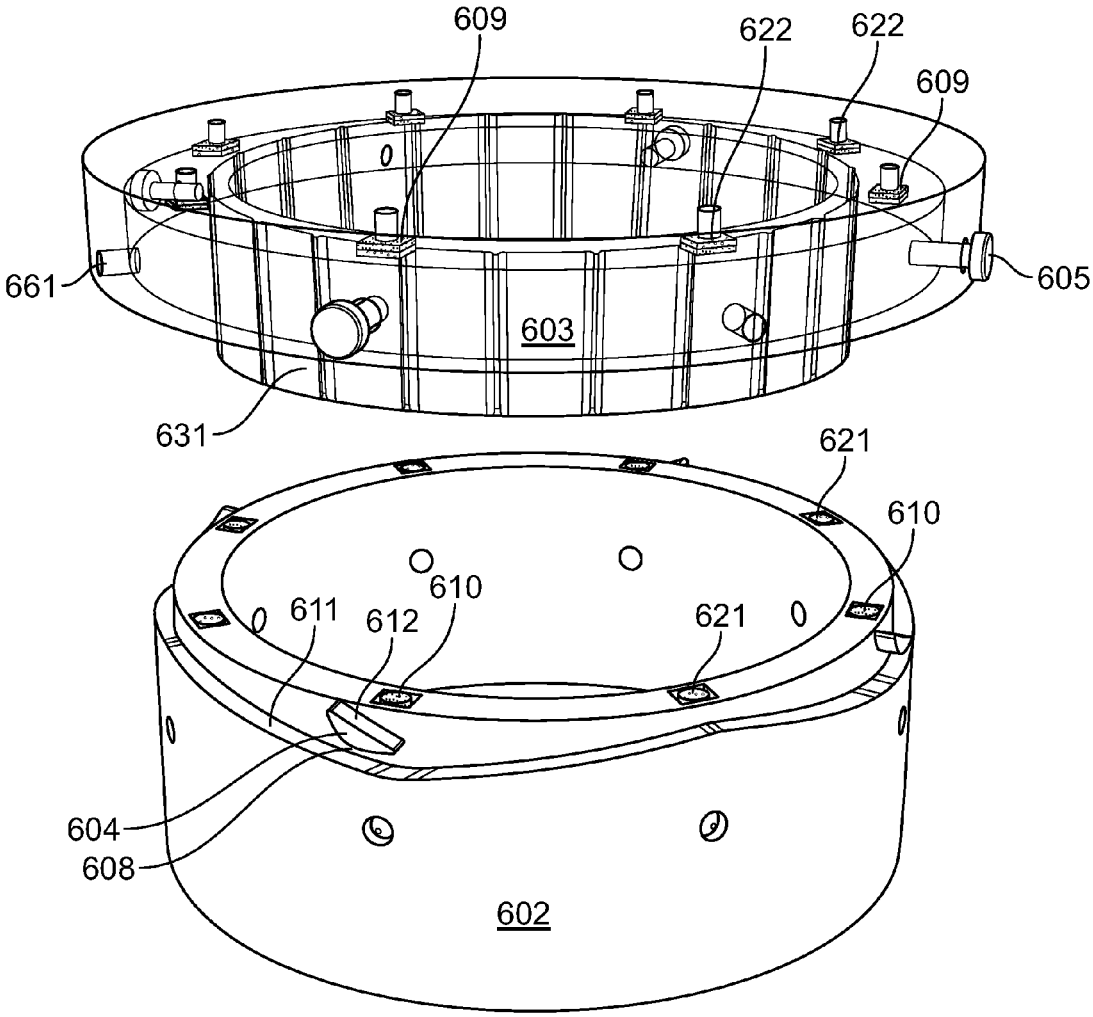
FIG. 4 shows another illustrative container in accordance with an alternate embodiment employing eight mutually attractive magnet pairs.

FIG. 4 shows another alternate embodiment having eight pairs of mutually attracting magnets, comprising four pairs 609, 610 in one N-S paired orientation, alternating around the circumference of lid 603 and body 602, with four pairs of magnets 622, 621 oriented in the opposite orientation. The first four pairs 609, 610 are respectively centered over interlocks 604, 605 and the second four pairs 621, 622 are respectively centered over the top-most areas of ramps 611.

It should be apparent that the various embodiments of the invention may be used for any type of rotating closure not necessarily associated with a cylindrical container, such as a gas tank or other filler cap, vent cap, or the like.

In addition, the principles of the invention could also be adapted to non-circular geometries, wherein a channel analogous to ramp 11 is linear, and, for example, there are two parallel rows of alternating opposing magnets rather than a circular arrangement.

Similarly, as mentioned above, in a rotating engagement embodiment, first and second interlock pieces 4 and 5 need not be aligned with magnets 9 and 10, but can be offset at any angle relative to the axis of a circular mechanism or relative to the length of a linear mechanism, so long as positioned so that second interlock piece 5 comes into alignment with first interlock piece 4 when magnets 9 and 10 (or corresponding mutually attractive elements) are aligned, in which case the deepest point of ramp 11 (or corresponding element) would also be moved to align with the lock position defined by the first and second interlock pieces.

Furthermore, interlocking pieces 4 and 5 could be interchanged with other interlocking elements known to those of skill in the art, including without limitation hooks, latches, interlocking grooves and the like.

The two embodiments shown in detail here have mutually attractive elements, in this case magnets, disposed differently, in one case to engage along a radius and in another case to engage axially. These are but two of numerous workable arrangements of mutually attractive or repulsive elements, and others that provide both forces to draw the closure pieces together and move them into locking alignment by rotation or sliding will be readily apparent to those of skill in the art. As previously mentioned, combinations of magnets and unmagnetized magnetic material may also be used as an alternative to magnet pairs.

As explained, a self-actuated closure in accordance with the present invention overcomes the shortcomings of the prior art in many respects. It only requires the placement and release of the lid (or other closing element) in order for it to automatically lock and seal. It does not require manual application of specific force to achieve a lock and seal, and can provide a positive and effective seal for a wide range of containers and contents. It can close automatically in a smooth and predictable manner, avoiding "blocked" or "hung" states in which closure stops short of full engagement. It can engage in a manner that provides strong, positive resistance to disengagement other than by means of a specific disengaging operation, and the disengaging operation involves different forces and movements than those resulting from routine storage and handling. The closure mechanism is readily capable of incorporating a positive seal for solid, liquid and/or gaseous contents.

It is apparent, therefore, that the invention meets the objectives set forth above and provides a number of advantages in terms of ease of use and effectiveness, over the prior art. Although the present invention has been described in detail, it should be understood that various changes, substitutions, and alterations may be readily ascertainable by those skilled in the art and may be made herein without departing from the spirit and scope of the present invention as defined by the claims.

We claim:

1. An closable assembly having a self-actuated closure, comprising (a) a body having a round section thereon;

(b) a cover having a round section thereon, said round section of said cover being engageable with said round section of said body, being relatively rotatable with respect to said body when engaging therewith, and having an axial position of approximate maximum engagement therewith, said position of approximate maximum engagement being such that, at said position, the axes of said round sections of said cover and said body are approximately aligned;

(c) a closure mechanism comprising a first and a second set of mutually interlocking assemblies, wherein the first said interlocking assembly is part of either said body or said cover, and the second said interlocking assembly part of the other of said body or said cover;

(d) said first interlocking assembly comprising at least one first interlock piece protruding in a radial direction with respect to the round section of the cover or body of which it is a part;

(e) said second interlocking assembly comprising at least one second interlock piece protruding in a radial direction with respect to the round section of the cover or body of which it is a part;

(f) said first and second interlock pieces being respectively positioned on said first interlock assembly and said second interlock assembly such that a radially extending portion of said first interlock piece is engageable with said a radially extending portion of said second interlock piece at about said axial position of approximate maximum engagement, said engagement of said first and second interlock pieces further defining an approximate rotational position of engagement;

(g) said cover and said body each further comprising at least one member of at least one pair of mutually attractive or repulsive elements;

(h) said mutually attractive or repulsive elements being respectively positioned on said body and said cover so as to cause relative rotation between said body and said cover to rotate first and second interlock pieces into mutual engagement when said body and said cover are brought into proximity of each other; and (i) said mutually attractive or repulsive members being further respectively positioned on said body and said cover so that upon reaching approximately their closest position relative to each other upon said engagement, said cover and said body are relatively positioned angularly at about said approximate rotational position of engagement of said first and second interlock pieces.

2. The assembly of claim 1, wherein said first interlocking assembly further comprises at least one ramp extending at least partially circumferentially around said round section, said ramp sloping from a position proximate the end of said first interlocking assembly that receives said second interlocking assembly (which end is considered as its top), to a position beneath said first interlock piece (relative to said top).

3. The assembly of claim 1, wherein said first interlock piece is generally shaped as an inverted circle segment, wherein the lower surface of said segment (relative to said top) deviates from circularity in one part by having a relatively flat approximately horizontal section thereat (relative to said top), and wherein the top surface of said segment (relative to said top) slopes downward (relative to said top).

4. The assembly of claim 1, wherein said second interlock piece is generally shaped as a cylindrical pin.

5. The assembly of claim 1, wherein said second interlock assembly further comprises a generally circularly shaped guide lip concentric with said round section of the body or cover to which it is attached, said guide lip having a diameter adapted to fit within or without the round section of the other of said body or cover.

6. The assembly of claim 5, wherein the first interlock piece is in accordance with claim 3 and the second interlock piece is in accordance with claim 4.

7. The assembly of claim 1, wherein said mutually attractive or repulsive elements comprise at least one magnet.

8. The assembly of claim 7, wherein said at least one magnet comprises a rare earth magnet.

9. The assembly of claim 7, wherein said at least one magnet comprises at least one magnet in said cover and at least one mutually attracting magnet in said body.

10. The assembly of claim 7, further comprising at least one unmagnetized element that is magnetically attracted to a magnet.

11. The assembly of claim 9, further comprising at least one additional magnet in said cover or said base, said additional magnet arranged to be mutually repulsive with at least one of said attracting magnets on the other of said cover or said base, and to be approximately furthest from said at least one attracting magnet at about said approximate rotational position of engagement of said first and second interlock pieces.

12. The assembly of claim 9, wherein said magnets comprise a plurality of pairs of mutually attracting magnets on each of said cover and said base, and wherein said first and said second interlock assemblies comprise a corresponding additional respective first and second interlock piece corresponding to each additional magnet pair, wherein the engagement of the respective pairs of first and second interlock pieces approximately rotationally coincide, and wherein each said magnet pair is in approximate mutual rotational alignment at about said approximate rotational position of engagement of said first and second interlock pieces.

13. The assembly of claim 12 further comprising a number of repulsively oriented magnets equal to the number of pairs of said mutually attracting magnets, said repulsively oriented magnets being placed in alternating positions with said mutually attracting magnets on said cover or said base and wherein each said repulsively oriented magnet is in approximate mutual rotational position of furthest disalignment with said at least one attracting magnet on the other of said cover or said base at about said approximate rotational position of engagement of the said first and second interlock pieces.

14. A self-closing container comprising (a) a body;

(b) a lid shaped to be engageable with said body, and rotatable when engaging therewith, said lid being regarded as being above said body for purposes of defining the orientation of the elements hereinafter recited;

(c) at least one first interlock piece fixedly disposed on and protruding in a radial direction with respect to said body;

(d) at least one second interlock piece fixedly disposed on and protruding in a radial direction with respect to said lid, said second interlock piece being positioned on said lid and shaped to engage said first interlock piece when said lid is closed on said body and rotated relative to said body to displace said interlock pieces into engagement, said rotational engagement having a rotationally defined area of interlock engagement, wherein, within said area of interlock engagement, an interlocking portion of said second interlock piece is disposed against an interlocking portion of said first interlock piece, and beneath said interlocking portion of said first interlock piece;

(e) at least one pair of mutually attractive (or repulsive) elements, the opposite elements of said pair being disposed respectively on said body and said lid, and positioned thereon such that their position of strongest attraction to (or repulsion from) each other, as said lid rotates relative to said body, approximately corresponds to the rotational position of said lid and said body when positioned in said area of interlock engagement; and (f) at least one ramp formed on said body, each such ramp corresponding to each of said at least one first interlock pieces, inclined relative to the direction of said lid to slope in the direction of said area of interlock engagement, and positioned on said body to receive said second interlock piece from above as said lid is drawn into compression with said body from a rotational position in which said second interlock piece is approaching a portion of said ramp from above said ramp;

(g) wherein an upper surface of said first interlock piece and a lower surface of said second interlock piece are each further shaped such that (a) said surfaces are slidable against each other in the direction corresponding to closer engagement of said lid and said body, in those cases in which said surfaces contact each other during closure of said lid against said body, and (b) such that said first interlock piece and said second interlock are slidable slide off of and out of contact with each other at a further position of relative rotation and compression of said lid and said body, above said ramp.

15. An closable assembly having a self-actuated closure, comprising a body having a generally arcuate section;

a cover having a generally arcuate section, said cover being engageable with said body and being relatively rotatable with respect to said body when engaging therewith, said cover having an axial position of approximate maximum engagement with said body wherein the axes of said generally arcuate sections of said cover and said body are approximately aligned;

a first interlock piece protruding in a radial direction with respect to said generally arcuate section of said cover;

a second interlock piece protruding in a radial direction with respect to said generally arcuate section of said body;

at least one pair of mutually attractive or repulsive elements, a first attractive or repulsive element coupled to said body, a corresponding second attractive or repulsive element coupled to said cover;

wherein said body and said cover have a first position with said first interlock piece circumferentially spaced from said second interlock piece, and a second position with said first interlock piece operatively engaged with said second interlock piece; and wherein said mutually attractive or repulsive elements generate relative movement between said body and said cover to rotate first and second interlock pieces from said first position to said second position when said body and said cover are brought into proximity of each other.

16. The assembly of claim 15, wherein said first interlock piece protrudes radially outward from said body and said second interlock piece protrudes radially inward from said cover.

17. The assembly of claim 15, wherein said first interlock piece protrudes radially inward from said body and said second interlock piece protrudes radially outward from said cover.

18. The assembly of claim 15, wherein said first position of said body and said cover further comprises said first interlock piece axially spaced from said second interlock piece, and wherein said relative rotational movement between said body and said cover axially displaces said first interlock piece into engagement with said second interlock piece in said second position.

19. The assembly of claim 15, further comprising a ramp extending a greater distance in a circumferential direction than at least one of said first or second interlock piece.

20. The assembly of claim 19, wherein said ramp is spaced from said second interlock piece.

* * * * *